US011927420B1

(12) United States Patent
Duan

(10) Patent No.: US 11,927,420 B1
(45) Date of Patent: Mar. 12, 2024

(54) EJECTION TOY

(71) Applicant: Xiang Duan, Shenzhen (CN)

(72) Inventor: Xiang Duan, Shenzhen (CN)

( * ) Notice: Subject to any disclaimer, the term of this patent is extended or adjusted under 35 U.S.C. 154(b) by 0 days.

(21) Appl. No.: 18/229,146

(22) Filed: Aug. 1, 2023

(51) Int. Cl.
*F41B 7/08* (2006.01)
*A63H 33/18* (2006.01)
*F41B 4/00* (2006.01)

(52) U.S. Cl.
CPC ..... *F41B 4/00* (2013.01)

(58) Field of Classification Search
CPC ..... F41B 3/02; F41B 4/00; F41B 7/00; F41B 7/046; F41B 7/08; F41B 11/89; A63H 33/18
USPC ..... 124/1, 16, 26, 27, 78, 35.1; 446/473
See application file for complete search history.

(56) References Cited

U.S. PATENT DOCUMENTS 4,676,219 A * 6/1987 Miller ..... F41B 7/025 124/19
5,437,260 A * 8/1995 King ..... F41B 5/126 124/25.5
5,460,150 A * 10/1995 Joppe ..... F41B 7/025 124/19
5,471,967 A * 12/1995 Matsuzaki ..... F41B 4/00 124/78
5,692,489 A * 12/1997 Swanson ..... F41B 7/02 124/19
5,711,285 A * 1/1998 Stewart ..... F41B 11/642 124/67
5,996,564 A * 12/1999 Kotowski ..... F41B 4/00 124/6
6,076,513 A * 6/2000 Doherty ..... F41B 11/89 124/66
6,523,535 B2 * 2/2003 Rehkemper ..... F41B 4/00 124/78
7,537,001 B2 * 5/2009 Ma ..... F41B 11/73 124/69
7,673,624 B2 * 3/2010 Rosella, Jr. ..... F41B 7/08 124/16
8,082,909 B2 * 12/2011 Sopinsky ..... F41B 7/08 124/16
8,387,605 B2 * 3/2013 Brown ..... F41B 7/08 124/66

(Continued)

FOREIGN PATENT DOCUMENTS

CN 210321405 U 4/2020
CN 212594005 U 2/2021
CN 218046458 U 12/2022

*Primary Examiner* — Alexander R Niconovich
(74) *Attorney, Agent, or Firm* — Olive Law Group, PLLC

(57) ABSTRACT

An ejection toy relating to the toy technology and comprising a casing, an elastic energy-storage & launching mechanism, a bullet, a string, a string retracting mechanism, an ejection locking mechanism and a driving component. The bullet is fit to the elastic energy-storage & launching mechanism and a container is set on the casing. The string retracting mechanism includes a string retracting wheel and a friction wheel, and the string is held between the string retracting wheel and friction wheel. The driving component is set in the casing for driving the string retracting wheel. The ejection locking mechanism is set on the casing for locking and fixing the bullet on the elastic energy-storage & launching mechanism or driving the string retracting wheel and friction wheel to release the string while unlocking the bullet.

18 Claims, 8 Drawing Sheets

(56) References Cited

U.S. PATENT DOCUMENTS

| | | | | |
|---|---|---|---|---|
| 8,393,299 | B1 * | 3/2013 | Bernat | F41B 7/003 42/70.11 |
| 8,596,255 | B2 * | 12/2013 | Meggs | F42B 6/10 124/56 |
| 8,662,060 | B2 * | 3/2014 | Walterscheid | F41B 5/0094 124/20.3 |
| 8,689,773 | B2 * | 4/2014 | Walterscheid | F41B 5/12 124/23.1 |
| 8,967,130 | B2 * | 3/2015 | Victor | F41B 7/08 124/16 |
| 8,997,727 | B1 * | 4/2015 | Hamel | A63H 33/18 124/16 |
| 9,097,477 | B1 * | 8/2015 | Mead | F41A 9/68 |
| 9,194,646 | B2 * | 11/2015 | Victor | F41B 7/08 |
| 9,303,942 | B2 * | 4/2016 | Sievers | A63B 65/122 |
| 9,513,075 | B2 * | 12/2016 | Lallier | F41A 9/73 |
| 9,562,739 | B2 * | 2/2017 | Busse | F41B 11/643 |
| 9,970,732 | B2 * | 5/2018 | Mellen | F41B 3/005 |
| 10,512,854 | B2 * | 12/2019 | Arnold | F41B 4/00 |
| 10,648,764 | B2 * | 5/2020 | Spielberger | F41B 7/006 |
| 10,663,249 | B1 * | 5/2020 | Liu | F41B 5/126 |
| 10,976,142 | B1 * | 4/2021 | Hilt | F41B 3/02 |
| 2002/0166551 | A1 * | 11/2002 | Lee | F41B 4/00 124/78 |
| 2015/0176940 | A1 * | 6/2015 | Cummings | F41B 5/0094 124/20.3 |
| 2016/0153738 | A1 * | 6/2016 | Cummings | F41B 5/0094 124/20.3 |
| 2022/0357125 | A1 * | 11/2022 | Hedeen, Jr. | F41B 4/00 |

* cited by examiner

EJECTION TOY

FIELD OF THE INVENTION

The present utility patent relates to the toy technology, and more particularly, to an ejection toy.

BACKGROUND OF THE INVENTION

Ejection toys are common toys that shoot at objects through elastic bullets for entertainment. In order to make them greater fun, in some ejection toys, a string is set between the bullet and ejection toy, which can not only help to draw back the bullet through the string after the bullet is shot, but also control the launching distance of the bullet relying on the length of the string, so as to improve the safety of the ejection toys. For example, a string launcher —China Patent Publication No.: CN217246756U, which is set with a reel entangled with a piece of string, is just one of them. Because the reel is entangled with a piece of string, the reel needs to be pulled through the string to rotate when the string launcher is ready for launch, affecting the launching speed of the string launcher. In addition, during launching of the string, when the bullet encounters a barrier, the reel rotates continuously due to inertia under an incomplete launching, which is liable to make part of the string fall off the reel and be jammed in the launch tube or the reel slot, causing knotting or seizing of the string, and then failing to retract the string smoothly by the string launcher; therefore, an improvement is needed.

DETAILED DESCRIPTION

The present utility patent aims to provide an ejection toy that can overcome the shortcomings and deficiencies of existing technology, prevent the string from entangling the reel, make the string be directly retracted in a container, reduce the resistance caused by pulling the reel during launching, avoid knotting or seizing of the string caused by part of the string falling off the reel and being jammed when the reel rotates continuously due to inertia under an incomplete launching, and achieve smoother bullet launching and/or string retracting.

In order to serve the above purposes, the technical scheme adopted by the present utility patent is: An ejection toy comprising a casing, an elastic energy-storage & launch mechanism, a bullet and a string, wherein the bullet is fit to the elastic energy-storage & launch mechanism; The casing is provided with a container for string retracting; The ejection toy also includes: a string retracting mechanism, an ejection locking mechanism and a driving component; The string retracting mechanism includes a movably set string retracting wheel in the container and a friction wheel, wherein the friction wheel is opposite to the string retracting wheel; The two ends of the string are respectively connected to the container and bullet, and the string is held between the string retracting wheel and friction wheel; The driving component is set in the casing for driving the string retracting wheel; The ejection locking mechanism is set on the casing for locking and fixing the bullet on the elastic energy-storage & launch mechanism or driving the string retracting wheel and friction wheel to release the string while unlocking the bullet.

One side of the casing is provided with a launch hole, and the elastic energy-storage & launch mechanism includes: a launch seat fixed in the casing; A launch tube connected to the launch hole is set on the launch seat, and a locking track is set at one end of the launch seat away from the launch hole; The locking track is connected to the container, and the bullet can sequentially pass through the launch hole, launch tube and locking track, from the outside to the inside, as well as a first elastic member that is set between the launch tube and launch hole to provide an elastic force for bullet launching.

The bottom of the container is provided with a movable hole for the string retracting wheel and the friction wheel to pass through, the outer wall of the bullet is provided with a snap-fit slot, the bottom of the locking track is provided with an opening; The ejection locking mechanism includes: A sliding a buckle component slidably set in the launch seat for snap-fitting to or separating from the snap-fit slot at one end; Two rocker arm sets fit symmetrically on both sides of the driving component, the rocker arm sets can rotate horizontally relative to the casing and the string retracting wheel and friction wheel are respectively set on the two rocker arm sets through second rotating shafts; And an operating component fit movably on the casing for operating by the user. The user can drive the sliding a buckle component to slide while driving the rocker arm sets to rotate horizontally relative to the casing through the operating component.

The bottom of the launch seat is provided with a sliding slot, and the operating component includes: A trigger slidably set outside the casing and hinged to one side of the launch seat; A linkage slidably set in the sliding slot and between the sliding a buckle component and trigger, a propping part for driving the sliding a buckle component is protrusively set on the linkage, and pushing parts for driving the rocker arm sets are set on both sides of the linkage; And a second elastic member connected to the launch seat and linkage at both ends for providing a restoring force for the linkage.

A first toggle part is protrusively set on one side of the trigger near the linkage, and an arc-shaped bulge part is protrusively set on the first toggle part; A second toggle part that can abut against the bulge part is set at the bottom of the linkage; A third sloping surface is set on the side where the second toggle part can abut against the bulge part.

A guide part is set below the locking track on the launch seat, a guide slot is set on the guide part that is connected to the opening of the locking track, and a chute is set on one side of the guide part near the linkage; The sliding a buckle component includes: A sliding buckle that is slidably set in the guide slot and can be snap-fitted to or separated from the snap-fit slot at one end, the sliding buckle is provided with a butt-joint slot on one side of the sliding buckle near the guide slot for inserting the propping part, the side of the inner wall of the butt-joint slot being away from the locking track is a first sloping surface, and the bottom of the propping part is provided with a second sloping surface that is abutting the first sloping surface; And a third elastic member set at the bottoms of the casing and sliding buckle at both ends to provide a restoring force for the sliding buckle.

Movable slots are set at the bottom of the launch seat and on both sides of the sliding a buckle component; Each rocker arm set includes: A rocker arm—one end of which is rotatably set into the casing through a first rotating shaft and the other end can abut against the pushing part and swing in a movable slot driven by the pushing part; And a fourth elastic member set within the movable slot and respectively connected to the side of the rocker arm away from the sliding a buckle component and the inner wall of the movable slot at both ends.

A fourth sloping surface is set on the side wall of the rocker arm away from the first rotating shaft, and the pushing part of the linkage is a fifth sloping surface abutting against the fourth sloping surface.

The driving component includes: A motor set in the casing; And a transmission component fixed on the output shaft of the motor and rotatably fit on the rocker arm through the second rotating shaft; The transmission component drives the string retracting wheel through the second rotating shaft.

The transmission component includes: A worm fixed on the output shaft of the motor; And a gear set within the rocker arm that can mesh with or separate from the worm driven by the rocker arm. The string retracting wheel rotates synchronously with the gear through the second rotating shaft.

The driving component further includes: A battery set in the casing for providing electrical energy to the motor; And a control switch set on the casing for controlling the motor.

The battery is a rechargeable battery, and the ejection toy further includes: A control circuit board set in the casing and electrically connected to the battery and the control switch; And a charging interface and an indicator light set on the casing and electrically connected to the control circuit board.

A strip hole runs through the middle of the linkage, a slider part is set on the launch seat in the sliding slot and in the strip hole, the second elastic member is set in the strip hole, and the two ends of the second elastic member abut the inner wall of the strip hole near the operating component and the slider part, respectively.

The container is provided with separator parts, which have openings connecting to the locking track; The separators are used to separate the string in the container from the string retracting wheel and the string in the container from the friction wheel.

Both sides of the casing are provided with wrist straps for the user.

The casing is provided with a motor support part for fixing the motor.

The string retracting wheel includes a first wheel body fixed on one end of a second rotating shaft; And a first flexible friction sleeve set outside the first wheel body.

The friction wheel includes: A second wheel body fixed on one end of the other second rotating shaft; And a second flexible friction sleeve set outside the second wheel body.

After adopting the above technical scheme, the beneficial effect of the present utility patent is: an ejection toy comprising a casing, an elastic energy-storage & launch mechanism, a bullet and a string. The elastic energy-storage & launch mechanism is set on the casing and the bullet is fit to the elastic energy-storage & launch mechanism. The elastic energy-storage & launch mechanism is used for launching the bullet, and the casing is provided with a container for string retracting. The driving component is set in the casing for driving the string retracting wheel. The ejection locking mechanism is set on the casing for locking and fixing the bullet on the elastic energy-storage & launch mechanism or driving the string retracting wheel and friction wheel to release the string while unlocking the bullet. When launching the bullet, the user can use the ejection locking mechanism to unlock the bullet while driving the string retracting wheel and friction wheel to release the string, making the elastic energy-storage & launch mechanism launch the bullet without entangling of the string around a reel. The string can be directly retracted in the container, reducing the resistance caused by pulling the reel during launching, avoiding knotting or seizing of the string caused by part of the string falling off the reel and being jammed when the reel rotates continuously due to inertia under an incomplete launching, and achieving smoother bullet launching and/or string retracting. The ejection locking mechanism can drive the string retracting wheel and friction wheel to approach each other to hold the string under its own restoring force. The driving component drives the string retracting wheel, and at the same time, the string retracting wheel drives the friction wheel under a friction force, making the string held between the string retracting wheel and friction wheel move towards the container under the friction force, and thus achieving string retracting.

DESCRIPTION OF THE DRAWINGS

In order to provide a clearer description of the embodiments regarding the present utility patent or the technical scheme in the prior art, below is a brief introduction to the drawings required in the embodiment or prior art description. Obviously, the drawings in the following description only relate to some embodiments of the present utility patent. For ordinary technicians in this art, other drawings can be obtained based on these ones without providing any creative labor.

Figure 1:
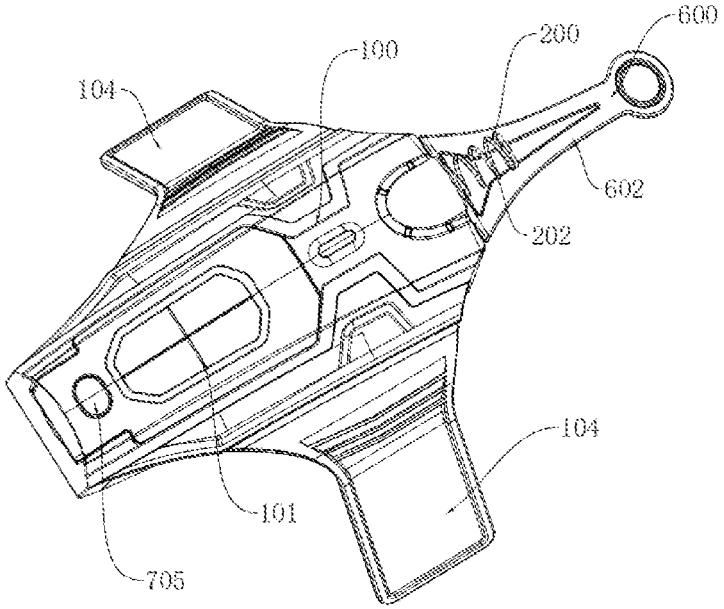
FIG. 1 shows a structural diagram of the present utility patent without bullet.

Drawing marks: 100, Casing; a, Container; 101, Protective cover; b, Launch hole; 102, Separator part; 103, Motor support part; 104, Wrist strap; 200, Elastic energy-storage & launch mechanism; 201, Launch seat; 202, First elastic member; c, Launch tube; d, Locking track; 300, bullet; e, Snap-fit slot; 400, String; 500, String retracting mechanism; 501, String retracting wheel; 502, Friction wheel; 503, First wheel body; 504, Second wheel body; 505, First flexible friction sleeve; 506, Second flexible friction sleeve; 600, Ejection locking mechanism; 601, Second rotating shaft; 602, Trigger; 603, Linkage; 604, Second elastic member; 605, Propping part; 606, Pushing part; f, Strip hole; 607, Slider part; 608, First toggle part; 609, Bulge part; 610, Second toggle part; 611, Guide part; g, Guide slot; h, Chute; 612, Sliding buckle; 613, Third elastic member; i, Butt-joint slot; j, Movable slot; k, Sliding slot; 614, Rocker arm; 615, Fourth elastic member; 616, First rotating shaft; 700, Driving component; 701, Motor; 702, Worm; 703, Gear; 704, Battery; 705, Control switch; 706, Control circuit board; 707, Charging interface; 708, Indicator.

DETAILED DESCRIPTION OF THE PREFERRED EMBODIMENTS

Below is a further description of the present utility patent based on the drawings.

This embodiment only shows an explanation of the present utility patent and is not a limitation to the present utility patent. Technicians in the art can make modifications to this embodiment as needed without making any creative contributions after reading this specification, which are always protected by the patent law as long as they are within the scope of the claims of the present utility patent.

This embodiment relates to an ejection toy, as shown in FIGS. 1-3 and 5, which comprises a casing 100, an elastic energy-storage & launch mechanism 200, a bullet 300 and a string 400. The elastic energy-storage & launch mechanism 200 is set on the casing 100 and the bullet 300 is fit to the elastic energy-storage & launch mechanism 200. The elastic energy-storage & launch mechanism 200 is used for launching the bullet 300, and the casing 100 is provided with a container a for string 400 retracting. In this embodiment, the opening of container a is detachably provided with a protective cover 101 for the user to arrange or replace the string 400 retracted in the container a. As shown in FIG. 3-6, the ejection toy also includes: a string retracting mechanism 500, an ejection locking mechanism 600 and a driving component 700; The string retracting mechanism 500 includes a movably set string retracting wheel 501 in the container a and a friction wheel 502, wherein the friction wheel 502 is opposite to the string retracting wheel 501; The two ends of the string 400 are respectively connected to the container a and bullet 300, and the string is held between the string retracting wheel 501 and friction wheel 502.

Optionally, one end of the string 400 is fixed in the container a through a screw, and the other end is tied and fixed to one end of the bullet 300. In other embodiments, the container a is provided with a fixing column, and both ends of the string 400 are tied to the fixing column and one end of the bullet 300, respectively. The driving component 700 is set in the casing 100 for driving the string retracting wheel 501. The ejection locking mechanism 600 is set on the casing 100 for locking and fixing the bullet 300 on the elastic energy-storage & launch mechanism 200 or driving the string retracting wheel 501 and friction wheel 502 to release the string 400 while unlocking the bullet 300. In some embodiments, the bullet 300 is detachably provided with a bullet-loading part at the end away from the locking track d. The bullet-loading part can be adsorbed on the object being shot due to its adsorption. The bullet-loading part and bullet 300 can be connected through magnetic suction, thread or snap-fit.

It should be noted that when launching the bullet 300, the user can use the ejection locking mechanism 600 to unlock the bullet 300 while driving the string retracting wheel 501 and friction wheel 502 to release the string 400, making the elastic energy-storage & launch mechanism 200 launch the bullet 300 without entangling of the string 400 around a reel. The string 400 can be directly retracted in the container a, reducing the resistance caused by pulling the reel during launching, making smoother bullet 300 launching, avoiding knotting or seizing of the string 400 caused by part of the string 400 falling off the reel and being jammed when the reel rotates continuously due to inertia under an incomplete bullet 300 launching, and achieving smoother bullet 300 launching and/or string 400 retracting. When the ejection toy is subject to string seizing, the string can be directly pulled out and then retracted through the string retracting mechanism. It is not necessary to disassemble the ejection toy and then arrange and retract the seized string, facilitating the maintenance of the ejection toy. The ejection locking mechanism 600 can drive the string retracting wheel 501 and friction wheel 502 to approach each other to hold the string 400 under its own restoring force. The driving component 700 drives the string retracting wheel 501, and at the same time, the string retracting wheel 501 drives the friction wheel 502 under a friction force, making the string 400 held between the string retracting wheel 501 and friction wheel 502 move towards the container a under the friction force, and thus achieving string retracting.

Preferably, as shown in FIGS. 3 and 6-9, one side of the casing 100 is provided with a launch hole b, and the elastic energy-storage & launch mechanism 200 includes: a launch seat 201 and a first elastic member 202. The launch seat 201 is fixed in the casing 100. The launch seat 201 is fixed in the casing 100 through screws. The launch seat 201 is provided with a launch tube c connected to the launch hole b. A locking track d is set at one end of the launch seat 201 away from the launch hole b. The locking track d is connected to the container a, and the bullet 300 can sequentially pass through the launch hole b, launch tube c and locking track d, from the outside to the inside. The first elastic member 202 passes through the launch tube c and launch hole b, providing elasticity for bullet 300 launching. The first elastic member 202 can be a spring, a spring piece, or a spring block. In this embodiment, the first elastic member 202 is a spring.

Figure 3:
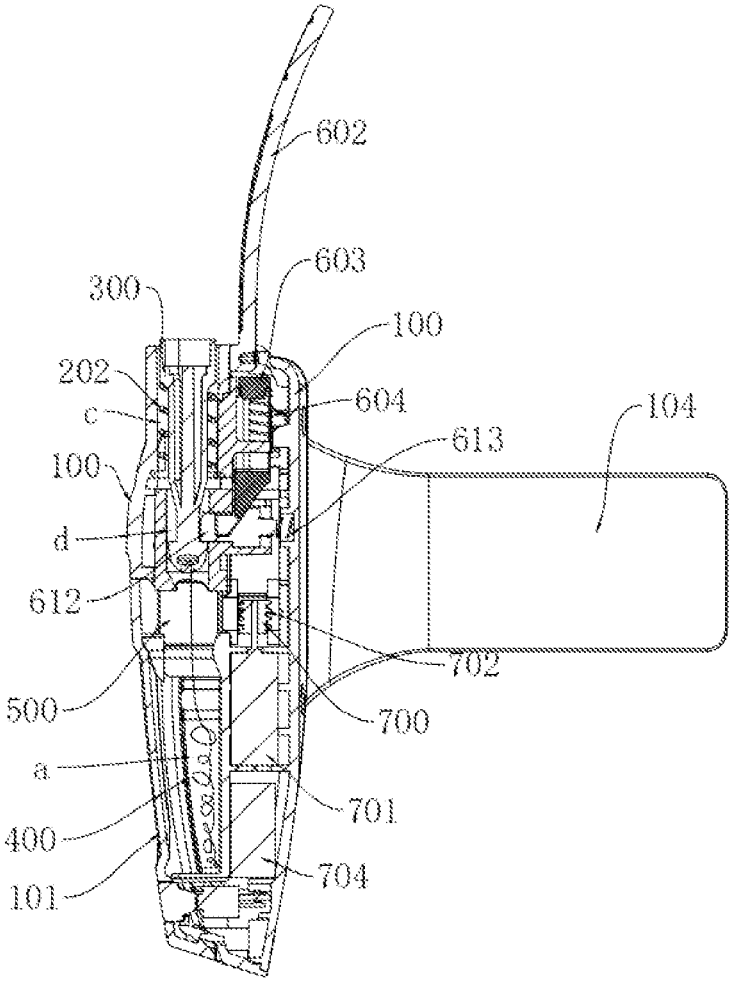
FIG. 3 shows a sectional view of the present utility patent.
Figure 4:
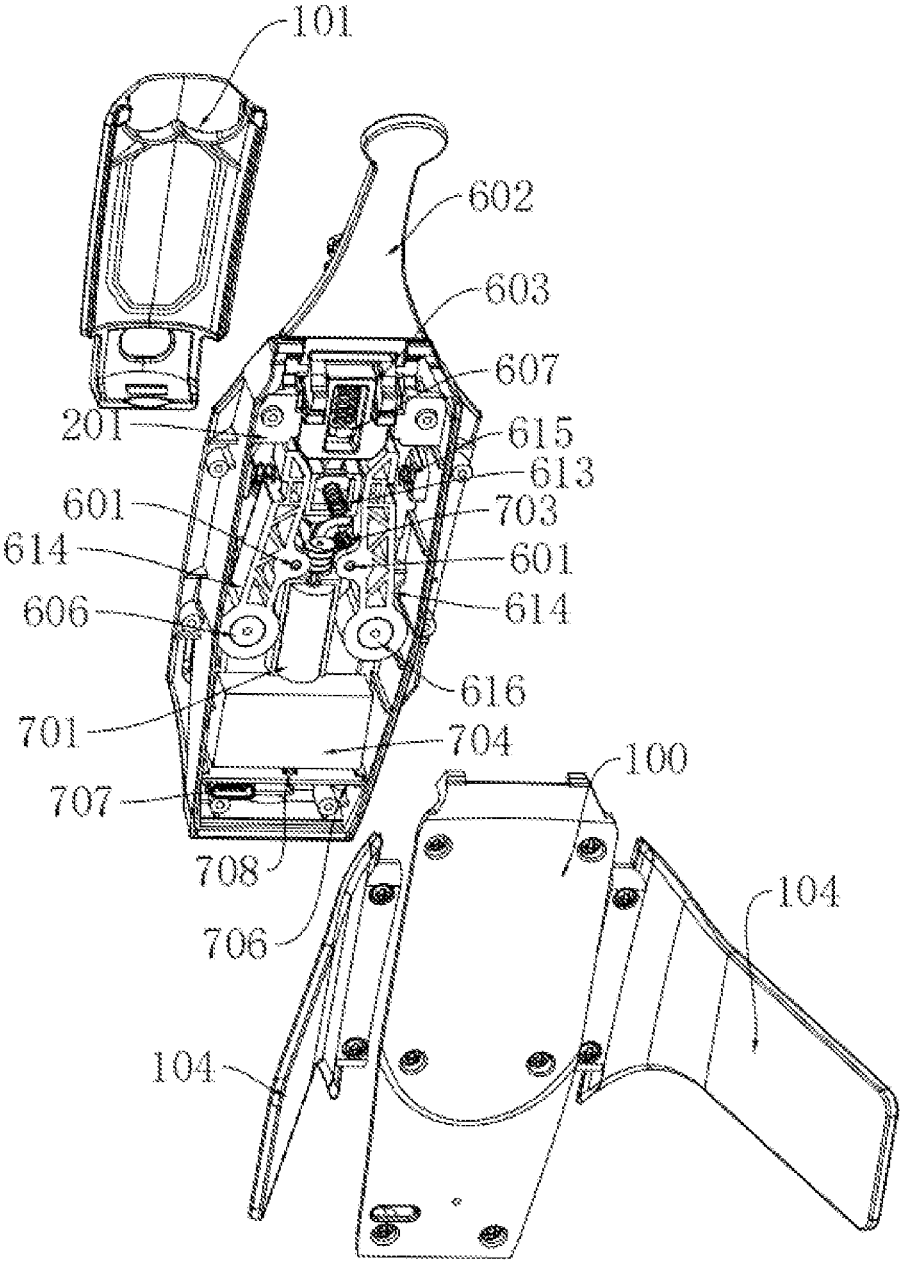
FIG. 4 shows the first explosion diagram of the present utility patent.
Figure 5:
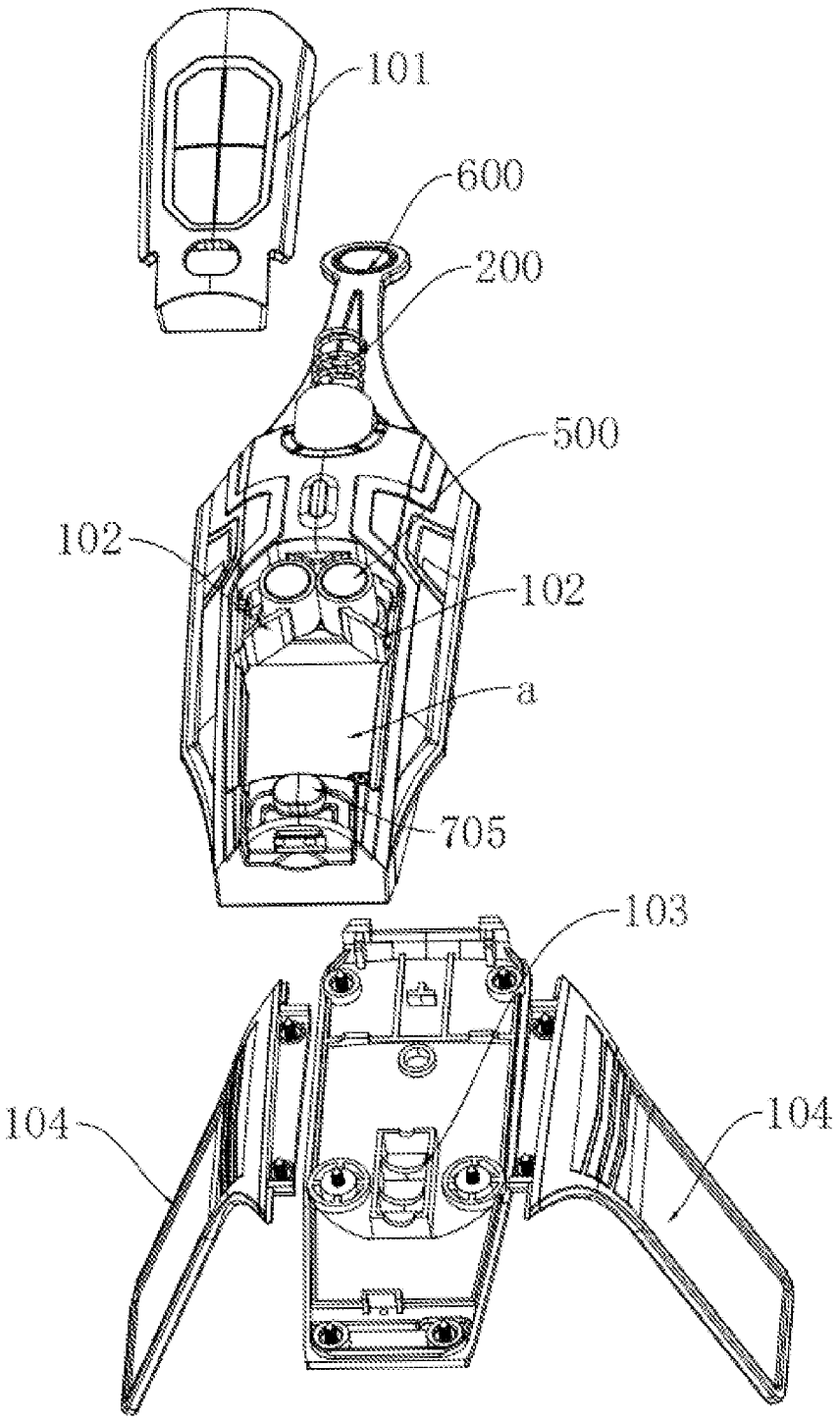
FIG. 5 shows the second explosion diagram of the present utility patent.

Preferably, in order to achieve the unlocking and locking of the bullet 300 by the ejection locking mechanism 600, and to drive the string retracting wheel 501 and friction wheel 502 to hold or release the string 400, as shown in FIGS. 3 and 5, a movable hole for the string retracting wheel 501 and the friction wheel 502 to pass through is set at the bottom of the container a, the outer wall of the bullet 300 is provided with a snap-fit slot e, the bottom of the locking track d is provided with an opening. As shown in FIG. 3-9, the ejection locking mechanism 600 includes: sliding a buckle component and rocker arm sets 614 and operating component. The sliding a buckle component is slidably set in the launch seat 201 for snap-fitting to or separating from the snap-fit slot e at one end. It should be noted that the bullet 300 is set with a limit position part at one end away from the string 400. When the bullet 300 is ready for launch, the ejection locking mechanism 600 will be snap-fitted to the snap-fit slot e of the bullet 300. At this time, one end of the first elastic member 202 will abut against the launch seat 201 and the other end will abut against the limit position part. The first elastic member 202 will be pressed for bullet 300 launching. Two rocker arm sets 614 are provided. The rocker arm sets 614 fit symmetrically on both sides of the driving component 700, the rocker arm sets 614 can rotate horizontally relative to the casing 100 and the string retracting wheel 501 and friction wheel 502 are respectively set on the two rocker arm sets 614 through second rotating shafts 601. The string retracting wheel 501 and friction wheel 502 are respectively fixed at the ends of the two second rotating shafts 601 and rotate synchronously with the second rotating shafts 601. An operating component is fit movably on the casing 100 for operating by the user. The user can drive the sliding a buckle component to slide while driving the rocker arm sets (614) to rotate horizontally relative to the casing 100 through the operating component.

Optionally, as shown in FIG. 3-9, the bottom of the launch seat 201 is provided with a sliding slot k, and the operating component includes: a trigger 602, a linkage 603 and a second elastic member 604. The trigger 602 is slidably set outside the casing 100 and hinged to one side of the launch seat 201. The linkage 603 is slidably set in the sliding slot k and between the sliding a buckle component and trigger 602. A propping part 605 for driving the sliding a buckle component is protrusively set on the linkage 603, and pushing parts 606 for driving the rocker arm sets 614 are set on both sides of the linkage 603. The second elastic member 604 is connected to the launch seat 201 and linkage 603 at both ends for providing a restoring force for the linkage 603. The second elastic member 604 can be a spring, a spring piece, or a spring block. In this embodiment, the second elastic member 604 is a spring.

Figure 6:
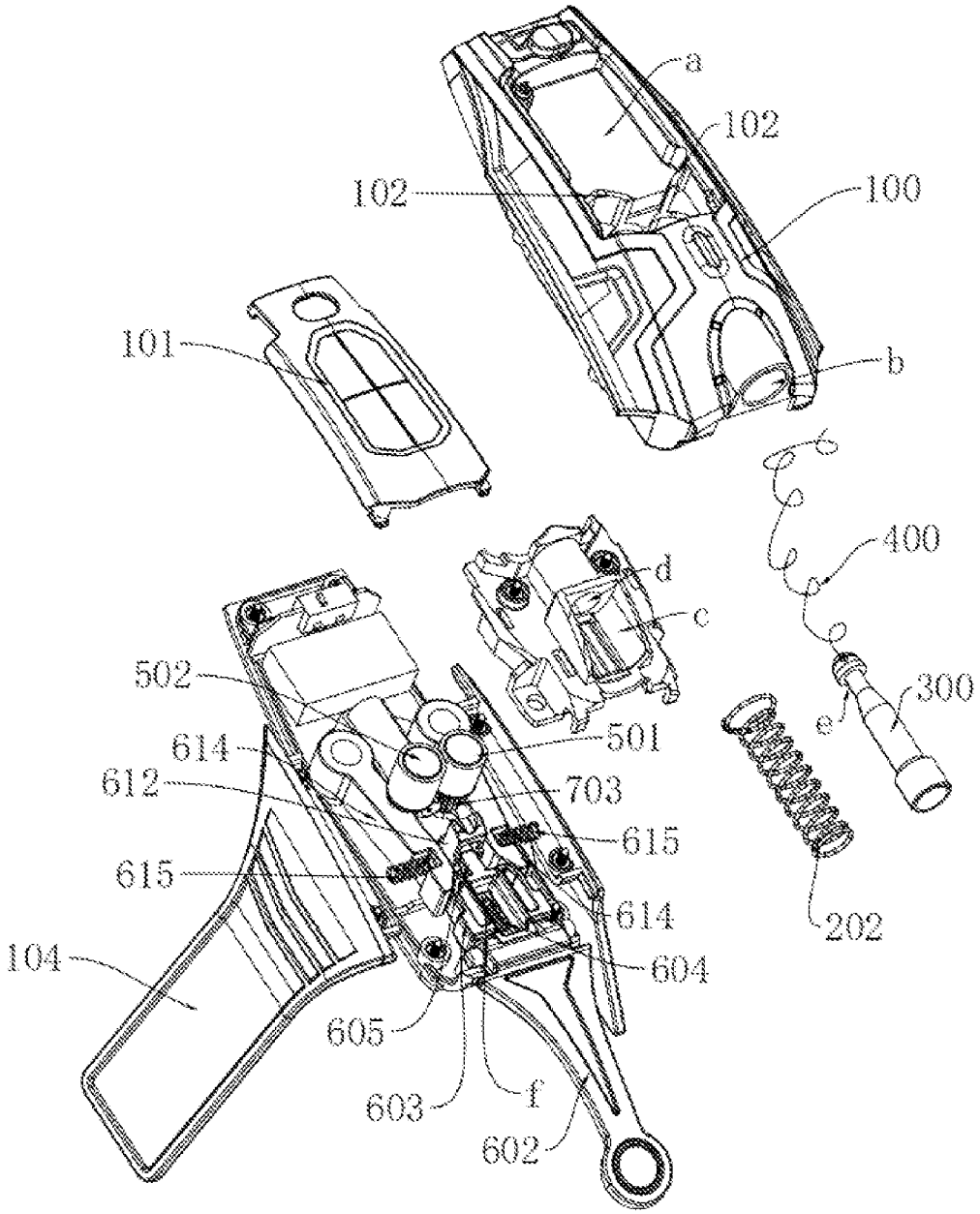
FIG. 6 shows the third explosion diagram of the present utility patent.

In other embodiments, as shown in FIGS. 3, 4, and 6, the operating component includes: a linkage 603 and a second elastic member 604. The linkage 603 is slidably set in the sliding slot k and between the sliding a buckle component and trigger 602. A propping part 605 for driving the sliding a buckle component is protrusively set on the linkage 603, and pushing parts 606 for driving the rocker arm sets 614 are set on both sides of the linkage 603. A pressing part is protrusively set on the side of the linkage 603 away from the propping part 605, which extends out of the casing 100 for the user to press. The two ends of the second elastic member 604 are respectively connected to the launch seat 201 and the linkage 603 to provide a restoring force for the linkage 603.

Figure 7:
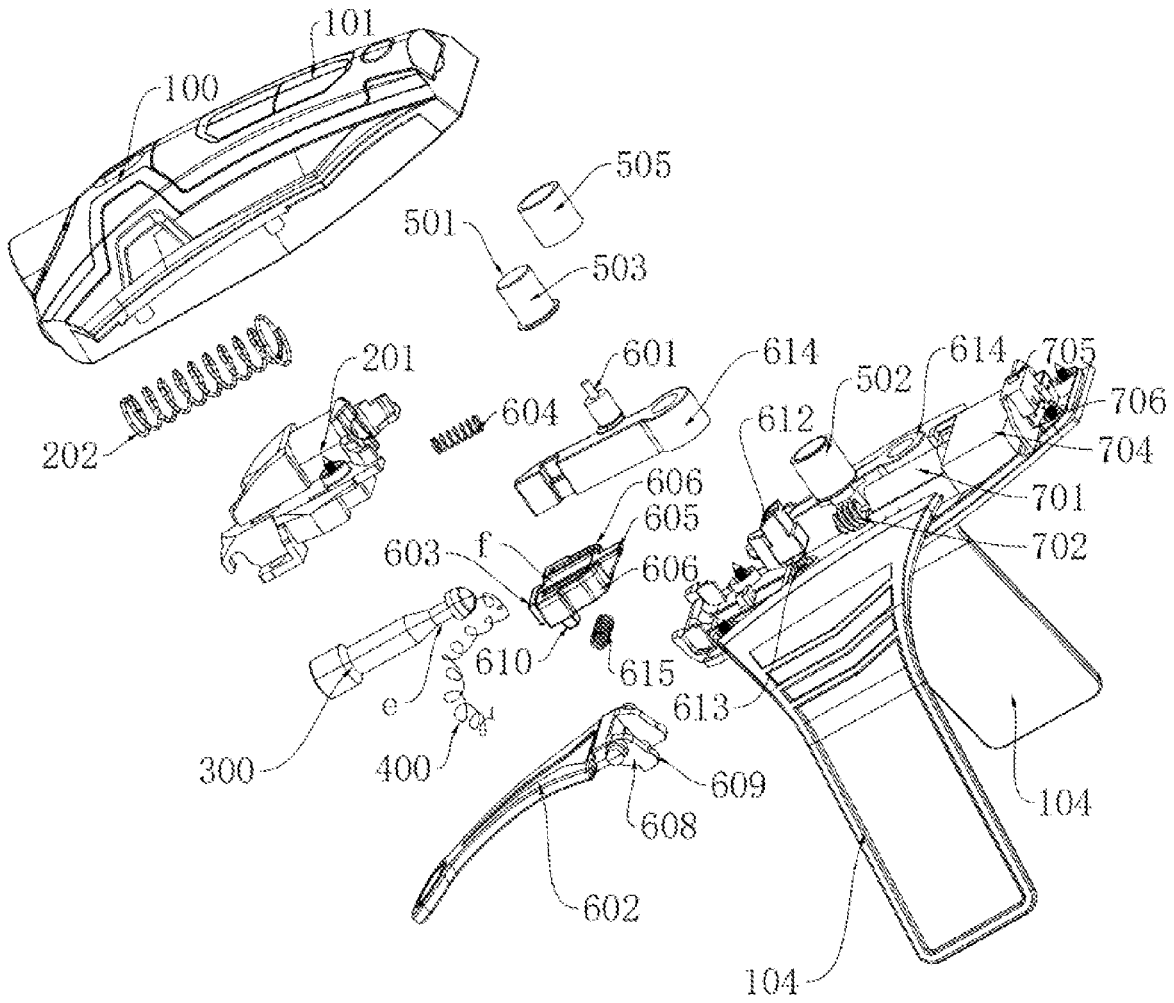
FIG. 7 shows the fourth explosion diagram of the present utility patent.
Figure 9:
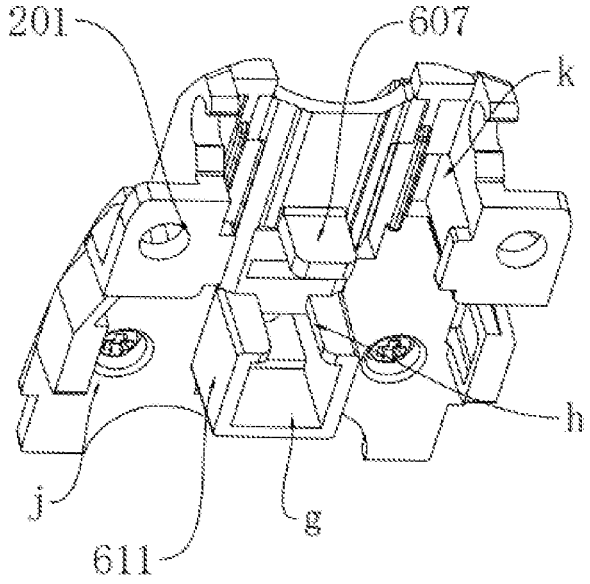
FIG. 9 shows a structural diagram of the launch seat of the present utility patent.

Optionally, as shown in FIGS. 7 and 9, a strip hole f runs through the middle of the linkage 603, a slider part 607 is set on the launch seat 201 in the sliding slot k and in the strip hole f, the second elastic member 604 is set in the strip hole f, and the two ends of the second elastic member 604 abut the inner wall of the strip hole f near the operating component and the slider part 607, respectively.

Figure 8:
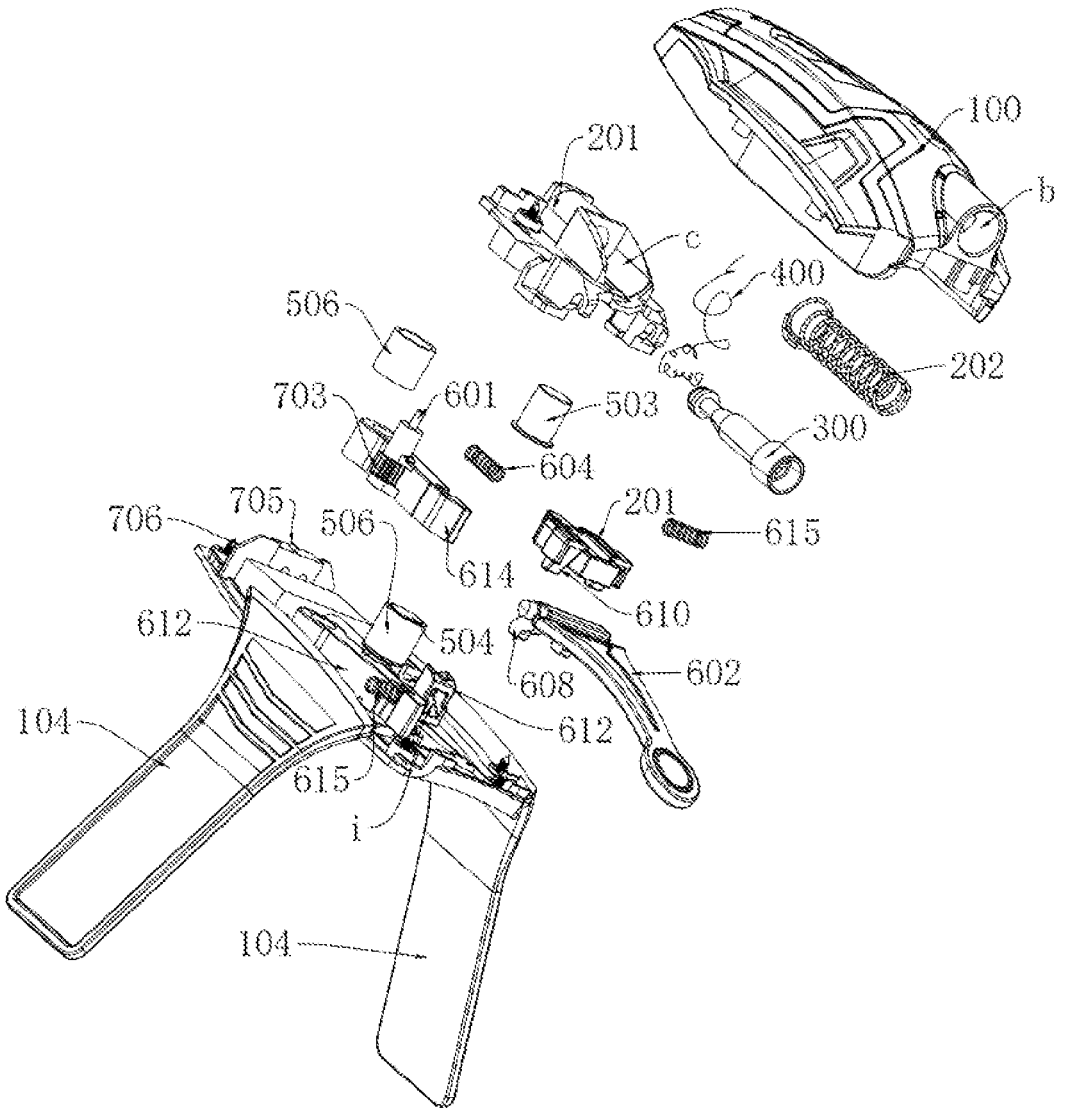
FIG. 8 shows the fifth explosion diagram of the present utility patent.

Preferably, in order to achieve the linking between trigger 602 and linkage 603, as shown in FIGS. 7 and 8, a first toggle part 608 is protrusively set on one side of the trigger 602 near the linkage 603, and an arc-shaped bulge part 609 is protrusively set on the first toggle part 608. A second toggle part 610 that can abut against the bulge part 609 is set at the bottom of the linkage 603, and a third sloping surface is set on the side where the second toggle part 610 can abut against the bulge part 609.

Preferably, in order to achieve the locking or unlocking of the bullet 300 by the sliding a buckle component, as shown in FIG. 9, a guide part 611 is set below the locking track d on the launch seat 201, a guide slot g is set on the guide part 611 that is connected to the opening of the locking track d, and a chute h is set on one side of the guide part 611 near the linkage 603. As shown in FIG. 6-8, the sliding a buckle component includes: A sliding buckle 612 and a third elastic member 613. The sliding buckle 612 is slidably set in the guide slot g and can be snap-fitted to or separated from the snap-fit slot e at one end. The sliding buckle 612 is provided with a butt-joint slot i on one side of the sliding buckle 612 near the guide slot g for inserting the propping part 605. The side of the inner wall of the butt-joint slot i being away from the locking track d is a first sloping surface, and the bottom of the propping part 605 is provided with a second sloping surface that is abutting the first sloping surface in order to achieve the linking between the linkage 603 and sliding buckle 612. A third elastic member 613 is set at the bottoms of the casing 100 and sliding buckle 612 at both ends to provide a restoring force for the sliding buckle 612. The third elastic member 613 can be a spring, a spring piece, or a spring block. In this embodiment, the third elastic member 613 is a spring.

Preferably, as shown in FIG. 3-8, movable slots j are set at the bottom of the launch seat 201 and on both sides of the sliding a buckle component; Each rocker arm 614 set includes: a rocker arm 614 and a fourth elastic member 615. One end of a rocker arm 614 is rotatably set into the casing 100 through a first rotating shaft 616 and the other end can abut against the pushing part 606 and swing in a movable slot j driven by the pushing part 606. It should be noted that one end of the rocker arm 614 can rotate horizontally around the first rotating shaft 616 in the movable slot j. A fourth elastic member 615 is set within the movable slot j and respectively connected to the side of the rocker arm 614 away from the sliding a buckle component and the inner wall of the movable slot j at both ends. The fourth elastic member 615 is used to provide a restoring force for the rocker arm 614. The fourth elastic member 615 can be a spring, a spring piece, or a spring block. In this embodiment, the fourth elastic member 615 is a spring. Furthermore, in order to achieve the linking between the linkage 603 and rocker arm 614, a fourth sloping surface is set on the side wall of the rocker arm 614 away from one end of the first rotating shaft 616. The pushing part 606 of the linkage 603 is a fifth sloping surface abutting against the fourth sloping surface.

Preferably, in order to achieve the automatic retracting of the string 400 by the string retracting mechanism 500, as shown in FIGS. 3, 4, and 7, the driving component 700 includes: A motor 701 and a transmission component. The motor 701 is set in the casing 100. The transmission component is fixed on the output shaft of the motor 701 and rotatably fit on the rocker arm 614 through the second rotating shaft 601. The transmission component drives the string retracting wheel 501 through the second rotating shaft 601. In this embodiment, the casing 100 is provided with a motor support part 103 for fixing the motor 701.

Figure 2:
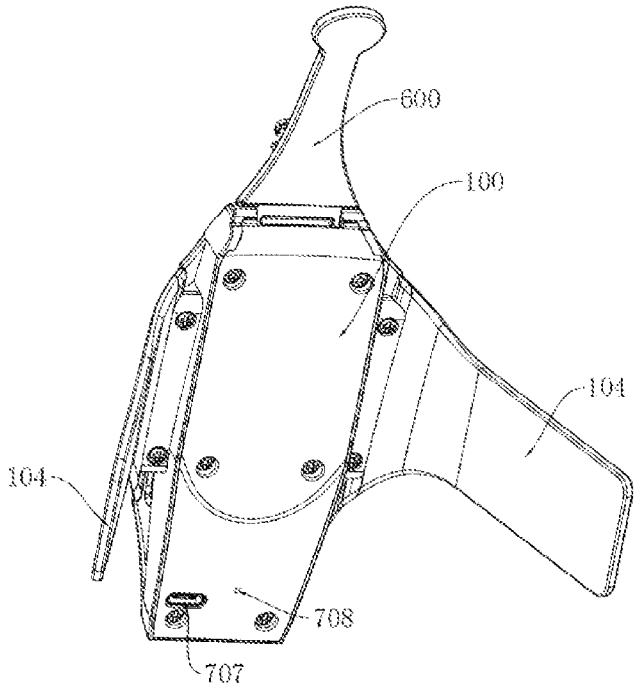
FIG. 2 shows a structure diagram in another direction of FIG. 1.

Preferably, the transmission component includes: a worm 702 and a gear 703. The worm 702 is fixed on the output shaft of the motor 701. The gear 703 is set within the rocker arm 614 that can mesh with or separate from the worm 702 driven by the rocker arm 614. The string retracting wheel 501 rotates synchronously with the gear 703 through the second rotating shaft 601. In other embodiments, the transmission component includes two bevel gears 703 that can mesh with each other. The two bevel gears 703 are respectively fixed to the output shaft of the motor 701 and the second rotating shaft 601 connected to the string retracting wheel 501. It should be noted that as shown in FIGS. 1, 2, and 7, the driving component 700 also includes: a battery 704, a control switch 705, a control circuit board 706, a charging interface 707 and an indicator light 708. The battery 704 is set in the casing 100 for providing electrical energy to the motor 701. The control switch 705 is set on the casing 100 and is used for controlling the motor 701. The battery 704 is a rechargeable battery 704, and the control circuit board 706 is set in the casing 100 and electrically connected to the battery 704 and control switch 705. The charging interface 707 and indicator light 708 are set on the casing 100 and electrically connected to the control circuit board 706. The charging interface 707 can be a micro-usb interface, a lighting interface, a type-c interface or an electrode charging interface 707. The indicator light 708 is used for indicating the charging status of the ejection toy.

It should be noted that when the bullet 300 is sequentially inserted into the launch hole b, launch tube c and locking track d, and the sliding buckle 612 snap-fits to the snap-fit slot e, the bullet 300 will compress the first elastic member 202. When the bullet 300 is ready for launch, the user can press the trigger 602, at this time, the bulge part 609 of the trigger 602 will push the linkage 603 to slide in the sliding slot k during rotation, making the linkage 603 move between the two rocker arms 614. The fourth sloping surface at one end of a rocker arm 614 contacts with the fifth sloping surface on the linkage 603, so the linkage 603 can expand the angle between the two rocker arms 614 during moving.

The rocker arms 614 can help to separate the gear 703 from the worm 702 during rotation while driving the string retracting wheel 501 and friction wheel 502 to release the string 400; At the same time, the sliding of the linkage 603 makes the propping part 605 of the linkage 603 insert into the butt-joint slot i along the first sloping surface, thereby driving the sliding buckle 612 to move downwards, separating the sliding buckle 612 from the snap-fit slot e of the bullet 300, unlocking the bullet 300 and allowing launching of the bullet 300 by the first elastic member 202. When the user releases the trigger 602, the linkage 603 can reset under the restoring force of the second elastic member 604, the sliding buckle 612 can reset under the restoring force of the third elastic member 613, and the rocker arms 614 can reset under the restoring force of the fourth elastic member 615, making the string retracting wheel 501 and friction wheel 502 hold the string 400. When retracting the string and pressing the control switch 705 to control the motor 701, the motor shaft can drive the worm 702 as well as the gear 703 to rotate. The gear 703 drives the string retracting wheel 501 through the second rotating shaft 601, and the string retracting wheel 501 drives the friction wheel 502 through friction while making the string 400 be retracted into the container a.

Preferably, in order to avoid entangling of the string 400 around the string retracting wheel 501 and/or friction wheel 502 during string retracting in the container a, as shown in FIG. 5, the container a is provided with separator parts 102. The separator parts 102 have openings connecting to the locking track (d); The separators are used to separate the string 400 in the container a from the string retracting wheel 501 and the string 400 in the container a from the friction wheel 502.

Preferably, considering the portability and the enhancement of the experience, as shown in FIGS. 1 and 2, the casing 100 is provided with wrist straps 104 on both sides for users.

Optionally, in order to achieve the rotation of the friction wheel 502 driven by the string retracting wheel 501 through friction, and then make the string 400 be retracted into the container a under the clamping between the string retracting wheel 501 and friction wheel 502. As shown in FIG. 6-8, the string retracting wheel 501 includes: a first wheel body 503 and a first flexible friction sleeve 505. The first wheel body 503 is fixed on one end of a second rotating shaft 601, and the first flexible friction sleeve 505 is set outside the first wheel body 503. The friction wheel 502 includes: a second wheel body 504 and a second flexible friction sleeve 506. The second wheel body 504 is fixed on one end of the other second rotating shaft 601, and the second flexible friction sleeve 506 is set outside the second wheel body 504. In this embodiment, both the first flexible friction sleeve 505 and the second flexible friction sleeve 506 are silicone sleeves or rubber sleeves. In other embodiments, both the friction wheel 502 and string retracting wheel 501 include a wheel body and a rubber material or other materials attached to the outer wall of the wheel bodies through injection molding for increasing the friction.

The above only aims to illustrate the technical scheme of the present utility patent without limitation. Any other modifications or equivalent replacements made by ordinary technicians in the art to the technical scheme of the present utility patent should be included in the scope of the claims of the present utility patent as long as they do not deviate from the technical scheme spirit and scope of the present utility patent.

The invention claimed is:

1. A ejection toy comprising:

a casing, wherein the casing is provided with a container for string retracting;

an elastic energy-storage & launch mechanism;

a bullet, wherein the bullet is fit to the elastic energy-storage & launch mechanism;

a string retracting mechanism that includes a movably set string retracting wheel in the container and a friction wheel; wherein the friction wheel is opposite to the string retracting wheel;

a string that two ends of the string are respectively connected to the container and the bullet, and the string is held between the string retracting wheel and friction wheel;

a driving component that is set in the casing for driving the string retracting wheel;

an ejection locking mechanism that is set on the casing for locking and fixing the bullet on the elastic energy-storage & launch mechanism or driving the string retracting wheel and friction wheel to release the string while unlocking the bullet.

2. The ejection toy according to claim 1, wherein one side of the casing is provided with a launch hole, and the elastic energy-storage & launching mechanism includes: a launch seat fixed in the casing; a launch tube connected to the launch hole is set on the launch seat, and a locking track is set at one end of the launch seat away from the launch hole; the locking track is connected to the container, and the bullet can sequentially pass through the launch hole, launch tube and locking track, from an outside to an inside, as well as a first elastic member that is set between the launch tube and launch hole to provide an elastic force for bullet launching.

3. The ejection toy according to claim 2, wherein a bottom of the container is provided with a movable hole for the string retracting wheel and the friction wheel to pass through, an outer wall of the bullet is provided with a snap-fit slot, a bottom of the locking track is provided with an opening; an ejection locking mechanism includes: a sliding a buckle component slidably set in the launch seat for snap-fitting to or separating from the snap-fit slot at one end; two rocker arm sets fit symmetrically on two sides of the driving component, the rocker arm sets can rotate horizontally relative to the casing and the string retracting wheel and friction wheel are respectively set on the rocker arm sets through a second rotating shafts; and an operating component fit movably on the casing for operating by users who can drive the sliding a buckle component to slide while driving the rocker arm sets to rotate horizontally relative to the casing through the operating component.

4. The ejection toy according to claim 3, wherein a bottom of the launch seat is provided with a sliding slot and the operating component includes: a trigger slidably set outside the casing and hinged to one side of the launch seat; a linkage slidably set in the sliding slot and between the sliding a buckle component and trigger, a propping part for driving the sliding a buckle component is protrusively set on the linkage, and pushing parts for driving the rocker arm sets are set on two sides of the linkage; a second elastic member connected to the launch seat and linkage at two ends for providing a restoring force for the linkage.

5. The ejection toy according to claim 4, wherein a first toggle part is protrusively set on one side of the trigger near the linkage, and an arc-shaped bulge part is protrusively set on the first toggle part; a second toggle part that can abut against the bulge part is set at a bottom of the linkage; a third sloping surface is set on a side where the second toggle part can abut against the bulge part.

6. The ejection toy according to claim 4, wherein a guide part is set below the locking track on the launch seat, a guide slot is set on the guide part that is connected to the opening of the locking track, and a chute is set on one side of the guide part near the linkage; the sliding a buckle component includes: a sliding buckle that is slidably set in the guide slot and can be snap-fitted to or separated from the snap-fit slot at one end, the sliding buckle is provided with a butt-joint slot on one side of the sliding buckle near the guide slot for inserting the propping part, a side of the inner wall of the butt-joint slot being away from the locking track is a first sloping surface, and a bottom of the propping part is provided with a second sloping surface that is abutting the first sloping surface; and a third elastic member set at the bottoms of the casing and sliding buckle at two ends to provide a restoring force for the sliding buckle.

7. The ejection toy according to claim 4, wherein movable slots are set at the bottom of the launch seat and on two sides of the sliding a buckle component; a rocker arm set includes: a rocker arm one end of which is rotatably set into the casing through a first rotating shaft and another end can abut against the pushing part and swing in a movable slot driven by the pushing part; and a fourth elastic member set within the movable slot and respectively connected to one side of the rocker arm away from the sliding a buckle component and an inner wall of the movable slot at two ends.

8. The ejection toy according to claim 7, wherein a fourth sloping surface is set on a side wall of the rocker arm away from the first rotating shaft, and the pushing part of the linkage is a fifth sloping surface abutting against the fourth sloping surface.

9. The ejection toy according to claim 7, wherein the driving component includes: a motor set in the casing; and a transmission component fixed on an output shaft of the motor and rotatably fit on the rocker arm through the second rotating shaft; the transmission component drives the string retracting wheel through the second rotating shaft.

10. The ejection toy according to claim 9, wherein the transmission component includes: a worm fixed on the output shaft of the motor; and a gear set within the rocker arm that can mesh with or separate from the worm driven by the rocker arm; the string retracting wheel rotates synchronously with the gear through the second rotating shaft.

11. The ejection toy according to claim 9, wherein the driving component further includes: a battery set in the casing for providing electrical energy to the motor; and a control switch set on the casing for controlling the motor.

12. The ejection toy according to claim 11, wherein the battery is a rechargeable battery, and the ejection toy further includes: a control circuit board set in the casing and electrically connected to the battery and the control switch; and a charging interface and an indicator light set on the casing and electrically connected to the control circuit board.

13. The ejection toy according to claim 9, wherein the casing is provided with a motor support part for fixing the motor.

14. The ejection toy according to claim 4, wherein a strip hole runs through a middle of the linkage, a slider part is set on the launch seat in the sliding slot and in the strip hole, the second elastic member is set in the strip hole, and the two ends of the second elastic member abut an inner wall of the strip hole near the operating component and the slider part, respectively.

15. The ejection toy according to claim 3, wherein the string retracting wheel includes a first wheel body fixed on one end of a second rotating shaft; and a first flexible friction sleeve set outside the first wheel body.

16. The ejection toy according to claim 15, wherein the friction wheel includes: a second wheel body fixed on one end of another second rotating shaft; and a second flexible friction sleeve set outside the second wheel body.

17. The ejection toy according to claim 2, wherein the container is provided with separator parts, which have openings connecting to the locking track; the separators are used to separate the string in the container from the string retracting wheel and the string in the container from the friction wheel.

18. The ejection toy according to claim 1, wherein two sides of the casing are provided with wrist straps for users.

* * * * *